US009434529B2

(12) United States Patent
McBroom et al.

(10) Patent No.: US 9,434,529 B2
(45) **Date of Patent: *Sep. 6, 2016**

(54) AEROSOL DISPENSER VALVE

(71) Applicant: Clayton Corporation, St. Louis, MO (US)

(72) Inventors: James P. McBroom, House Springs, MO (US); Joseph C. Lott, Des Peres, MO (US); Clyde E. Smothers, Fenton, MO (US)

(73) Assignee: Clayton Corporation, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/971,317

(22) Filed: Aug. 20, 2013

(65) Prior Publication Data

US 2013/0341552 A1 Dec. 26, 2013
US 2014/0166920 A2 Jun. 19, 2014

Related U.S. Application Data

(63) Continuation of application No. 13/189,656, filed on Jul. 25, 2011, now Pat. No. 8,511,521, which is a continuation of application No. 11/228,000, filed on Sep. 15, 2005, now Pat. No. 7,984,834.

(60) Provisional application No. 60/627,850, filed on Nov. 15, 2004, provisional application No. 60/610,282, filed on Sep. 16, 2004.

(51) Int. Cl.

*B65D 83/44* (2006.01)
*B65D 83/14* (2006.01)
*B65D 83/46* (2006.01)

(52) U.S. Cl.

CPC ..... *B65D 83/44* (2013.01); *B65D 83/14* (2013.01); *B65D 83/46* (2013.01); *B65D 83/75* (2013.01)

(58) Field of Classification Search

CPC ..... B65D 83/14; B65D 83/42; B65D 83/44; B65D 83/46; B65D 83/75; B65D 83/752; B65D 83/753

USPC ..... 222/402.1, 402.21, 402.24, 394, 320, 222/321.6, 321.1

See application file for complete search history.

(56) References Cited

U.S. PATENT DOCUMENTS 3,830,760 A 8/1974 Bengtson
3,954,208 A 5/1976 Brill (Continued)

FOREIGN PATENT DOCUMENTS

EP 1 606 195 B1 3/2007
EP 1 577 229 A2 9/2009

(Continued)

OTHER PUBLICATIONS

*Clayton Corporation* v. *Momentive Performance Materials Inc., Lindal North America, Inc. and Altachem NV*, "Complaint," Case No. 4:12-cv-01349-AGF, Filed Jul. 30, 2012, 9 pages.

(Continued)

*Primary Examiner* — J. Casimer Jacyna
(74) *Attorney, Agent, or Firm* — Senniger Powers LLP

(57) ABSTRACT

An improved valve member, aerosol dispenser valve containing the valve member, aerosol container for dispensing moisture curable foams, and moisture curable foam and dispenser, in which the valve member is made of a glass filled polyolefin. The polyolefin is preferably a polyethylene. The glass content is between about 2% and about 40%, more preferably between about 10% and about 30%; and most preferably between about 15% and about 25%.

15 Claims, 1 Drawing Sheet

(56) References Cited

U.S. PATENT DOCUMENTS

| | | | | |
|---|---|---|---|---|
| 4,216,884 | A | 8/1980 | Giuffredi | |
| 4,429,814 | A | 2/1984 | Scotti et al. | |
| 4,437,592 | A | 3/1984 | Bon | |
| 4,558,073 | A | 12/1985 | Kluth et al. | |
| 4,667,855 | A | 5/1987 | Holleran | |
| 4,852,807 | A | 8/1989 | Stoody | |
| 4,865,351 | A | 9/1989 | Smithson et al. | |
| 5,014,887 | A | 5/1991 | Kopp | |
| 5,456,386 | A | 10/1995 | Jesswein | |
| 5,553,755 | A | 9/1996 | Bonewald et al. | |
| 5,687,911 | A | 11/1997 | Boakye-Danquah et al. | |
| 5,836,299 | A | 11/1998 | Kwon | |
| 5,865,351 | A | 2/1999 | De Laforcade | |
| 5,894,958 | A * | 4/1999 | De Laforcade | 222/136 |
| 5,916,953 | A | 6/1999 | Jacoby et al. | |
| 5,921,447 | A | 7/1999 | Barger et al. | |
| 5,975,356 | A | 11/1999 | Yquel et al. | |
| 5,988,699 | A | 11/1999 | Quandt | |
| 6,013,691 | A | 1/2000 | Braun et al. | |
| 6,113,070 | A | 9/2000 | Holzboog | |
| 6,202,899 | B1 | 3/2001 | Lasserre et al. | |
| 6,245,415 | B1 | 6/2001 | Keller et al. | |
| 6,291,580 | B1 | 9/2001 | Kukkala et al. | |
| 6,750,265 | B2 | 6/2004 | Pauls et al. | |
| 7,226,553 | B2 | 6/2007 | Jackson et al. | |
| 7,227,108 | B2 | 6/2007 | Clothier et al. | |
| 7,282,170 | B2 | 10/2007 | Dutmer et al. | |
| 7,456,242 | B2 | 11/2008 | Smith et al. | |
| 7,984,834 | B2 * | 7/2011 | McBroom et al. | 222/402.1 |
| 8,511,521 | B1 * | 8/2013 | McBroom et al. | 222/402.1 |
| 2002/0132950 | A1 | 9/2002 | Smith et al. | |
| 2004/0025852 | A1 | 2/2004 | Kanekawa et al. | |
| 2004/0104373 | A1 | 6/2004 | Dutmer et al. | |
| 2004/0260046 | A1 * | 12/2004 | Smith et al. | 526/352 |
| 2005/0011883 | A1 | 1/2005 | Clothier et al. | |
| 2006/0065678 | A1 | 3/2006 | McBroom et al. | |

FOREIGN PATENT DOCUMENTS

| | | | |
|---|---|---|---|
| EP | 2 664 649 | A2 | 11/2013 |
| WO | 97/49974 | A1 | 12/1997 |
| WO | 2005/102867 | A1 | 11/2005 |
| WO | 2011/095499 | A1 | 8/2011 |

OTHER PUBLICATIONS

*Clayton Corporation* v. *Momentive Performance Materials Inc., Lindal North America, Inc. and Altachem NV*, "Lindal North America, Inc. and Altachem Nv's Answer and Counterclaims," Case No. 4:12-cv-01349-AGF, Filed Oct. 4, 2012, 9 pages.

*Clayton Corporation* v. *Momentive Performance Materials Inc., Lindal North America, Inc. and Altachem NV*, "Momentive Performance Materials Inc.'s Answer to Clayton Corporation's Complaint," Case No. 4:12-cv-01349-AGF, Filed Oct. 4, 2012, 9 pages.

*Clayton Corporation* v. *Momentive Performance Materials Inc., Lindal North America, Inc. and Altachem NV*, "Clayton Corporatin's Answer to Defendant's Counterclaims," Case No. 4:12-cv-01349-AGF, Filed Oct. 29, 2012, 5 pages.

*Clayton Corporation* v. *Momentive Performance Materials Inc., Lindal North America, Inc. and Altachem NV*, "Lindal North America, Inc. and Altachem Nv's Answer and First Amended Counterclaims," Case No. 4:12-cv-01349-AGF, Filed Jul. 15, 2013, 13 pages.

*Clayton Corporation* v. *Momentive Performance Materials Inc., Lindal North America, Inc. and Altachem NV*, "Clayton Corporation's Answer to Defendants' First Amended Counterclaims," Case No. 4:12-cv-01349-AGF, Filed Aug. 1, 2012, 6 pages.

*Clayton Corporation* v. *Momentive Performance Materials Inc., Lindal North America, Inc. and Altachem NV*, "Clayton's Disclosure of Asserted Claims and Preliminary Infringement Contentions Against Defendant Momentive Performance Materials Inc. Under Local Patent R. 3-1," Case No. 4:12-cv-01349-AGF, Filed Mar. 29, 2013, 10 pages.

*Clayton Corporation* v. *Momentive Performance Materials Inc., Lindal North America, Inc. and Altachem NV*, "Clayton's Disclosure of Asserted Claims and Preliminary Infringement Contentions Against Defendants Lindal and Altachem Under Local Patent R. 3-1," Case No. 4:12-cv-01349-AGF, Filed Mar. 29, 2013, 12 pages.

*Clayton Corporation* v. *Momentive Performance Materials Inc., Lindal North America, Inc. and Altachem NV*, "Altachem NV's and Lindal North America, Inc.'s Preliminary Counter-Infringement Contentions," Case No. 4:12-cv-01349-AGF, Filed Apr. 26, 2013, 10 pages.

*Clayton Corporation* v. *Momentive Performance Materials Inc., Lindal North America, Inc. and Altachem NV*, "Momentive Performance Materials, Inc.'s Preliminary Counter-Infringement Contentions," Case No. 4:12-cv-01349-AGF, Filed Apr. 26, 2013, 12 pages.

*Clayton Corporation* v. *Momentive Performance Materials Inc., Lindal North America, Inc. and Altachem NV*, "Altachem Nv's and Lindal North America, Inc.'s Preliminary Invalidity Contentions," Case No. 4:12-cv-01349-AGF, Filed May 17, 2013, 57 pages.

*Clayton Corporation* v. *Momentive Performance Materials Inc., Lindal North America, Inc. and Altachem NV*, Excerpts of "Clayton Corporation's Answers to Lindal North America, Inc. and Altachem NV's First Set of Interrogatories (Nos. 1-12)," Case No. 4:12-cv-01349-AGF, Filed Nov. 29, 2013, 10 pages.

*Clayton Corporation* v. *Momentive Performance Materials Inc., Lindal North America, Inc. and Altachem NV*, "Altachem NV's and Lindal North America, Inc.'s Memorandum in Support of Their Motion for Claim Construction", Case No. 4:12-cv-01349-AGF, Filed Sep. 9, 2013, 22 pages.

*Clayton Corporation* v. *Momentive Performance Materials Inc., Lindal North America, Inc. and Altachem NV*, "Clayton's Memorandum in Support of Its Motion for Claim Construction", Case No. 4:12-cv-01349-AGF, Filed Sep. 9, 2013, 20 pages.

*Clayton Corporation* v. *Momentive Performance Materials Inc., Lindal North America, Inc. and Altachem NV*, "Altachem NV's and Lindal North America, Inc.'s Reply Memorandum in Support of Their Motion for Claim Construction", Case No. 4:12-cv-01349-AGF, Filed Sep. 24, 2013, 18 pages.

*Clayton Corporation* v. *Momentive Performance Materials Inc., Lindal North America, Inc. and Altachem NV*, "Clayton's Responsive Claim Construction Memorandum", Case No. 4:12-cv-01349-AGF, Filed Sep. 24, 2013, 20 pages.

De Beir, K., "Design of a 2-Component System and a Non-Adherent Tipping Valve Aerosol," A Thesis Presented to the Department of Industrial Sciences of Hogeschool (University College) Gent, Jun. 2004, 150 pages.

Opposition Against Clayton's European Patent 1 789 343 B1, "Altachem's Grounds for Opposition," Filed Aug. 22, 2012, 24 pages.

Opposition Against Clayton's European Patent 1 789 343 B1, "Letter from the Opponent," Filed Dec. 10, 2012, 4 pages.

Opposition Against Clayton's European Patent 1 789 343 B1, "Letter from the Proprietor," Filed Mar. 28, 2013, 16 pages.

Opposition Against Clayton's European Patent 1 789 343 B1, "Letter from the Opponent," Filed Jun. 29, 2013, 9 pages.

Plast-O-Matic Valves, Inc., "Introduction to Plastic Valves," accessed at http://www.plastomatic.com/intro-to-plastic-valves-ebook.pdf, Dated Apr. 20, 2003, 45 pages.

ASTM International, "Designation D 5630-01—Standard Test Method for Ash Content in Plastics," 2001, 5 pages.

Basell Technology Company, Hostacom G2 U02 Product Sheet, Feb. 26, 2004, 2 pages.

British Standard, "Plastics—Determination of Ash, Part 1: General Methods," Jul. 1997, pp. 1-4.

*Clayton Corporation* v. *Momentive Performance Materials Inc., Lindal North Amerida, Inc. and Altachem NV*, "Ghent Courting Ruling for EP 1 789 343," Issued Jun. 19, 2014, 33 pages.

*Clayton Corporation* v. *Momentive Performance Materials Inc., Lindal North America, Inc. and Altachem NV*, "Certified Translation of Ghent Court Ruling for EP 1 789 343," Case No. 4:13-cv-001349-AGF, Filed Jun. 19, 2014, 32 pages.

(56) References Cited

OTHER PUBLICATIONS

*Clayton Corporation* v. *Momentive Performance Materials Inc., Lindal North America, Inc. and Altachem NV*, "Markman Order," Case No. 4:12-cv-01349-AGF, Filed Sep. 30, 2014, 41 pages.
*Clayton Corporation* v. *Momentive Performance Materials Inc., Lindal North America, Inc. and Altachem NV*, "Clayton's Disclosure of Asserted Claims and Final Infringement Contentions Against Defendants Lindal and Altachem Under Local Patent R. 3-7," Case No. 4:12-cv-01349-AGF, Filed Nov. 20, 2014, 14 pages.
*Clayton Corporation* v. *Momentive Performance Materials Inc., Lindal North America, Inc. and Altachem NV*, "Altachem NV's and Lindal North America, Inc.'s Final Invalidity Contentions," Case No. 4:12-cv-01349-AGF, Filed Nov. 20, 2014, 62 pages.
*Clayton Corporation* v. *Momentive Performance Materials Inc., Lindal North America, Inc. and Altachem NV*, "Altachem NV's and Lindal North America, Inc.'s Final Counter-Infringement Contentions," Case No. 4:12-cv-01349-AGF, Filed Nov. 20, 2014, 9 pages.
Communication Pursuant to Article 94(3) EPC issued for European Patent 1 789 343 B1, dated Jun. 3, 2009, 2 pages.
Communication Pursuant to Article 94(3) EPC issued for European Patent 1 789 343 B1, dated Jan. 7, 2011, 4 pages.
De Schrijver, A., The Foam Manual, 2012, pp. 13-21 and 98-131, Kluwer Technische Boeken.
European Search Opinion issued for European Patent 1 789 343 B1, dated Aug. 5, 2008, 3 pages.
Harper, C. A., Handbook of Plastics and Elastomers, 1975, pp. 1-96, 1-97, 1-100, 1-101, and 2-66 through 2-69, 1975, McGraw-Hill Book Company.
International Preliminary Report on Patentability issued for European Patent 1 789 343 B1, dated Mar. 20, 2007, 4 pages.
International Search Report issued for European Patent 1 789 343 Bl, dated Feb. 16, 2007, 3 pages.
Observations by Third Parties for European Patent 1 789 343 B1, filed Jun. 8, 2009, 4 pages.
Observations by Third Parties for European Patent 1 789 343 B1, filed Dec. 4, 2009, 5 pages.
Opposition Against Clayton's European Patent 1 789 343 B1, "Letter Regarding the Opposition Procedure (No Time Limit)," Filed Dec. 11, 2012, 4 pages.
Opposition Against Clayton's European Patent 1 789 343 B1, "Reply of the Patent Proprietor to the Notice(s) of Opposition," Filed Mar. 28, 2013, 16 pages.
Opposition Against Clayton's European Patent 1 789 343 B1, "Translation of the Evidence During Opposition Procedure," Filed Mar. 28, 2013, 16 pages.
Opposition Against Clayton's European Patent 1 789 343 B1, "Letter Regarding the Opposition Procedure (No Time Limit)," Filed Feb. 21, 2014, 4 pages.
Opposition Against Clayton's European Patent 1 789 343 B1, "Witness Statement of Jan De Strooper (including attachments)," Dec. 19, 2013, 29 pages.
Opposition Against Clayton's European Patent 1 789 343 B1, "Letter Regarding the Opposition Procedure (No Time Limit)," Filed Apr. 8, 2014, 4 pages.
Opposition Against Clayton's European Patent 1 789 343 B1, "Annex to the Communication," Sep. 10, 2014, 8 pages.
Opposition Against Clayton's European Patent 1 789 343 B1, Written Submission in Preparation to/during Oral Proceedings, Filed Dec. 23, 2014, 28 pages.
Opposition Against Clayton's European Patent 1 789 343 B1, Written Submission in Preparation to/during Oral Proceedings, Filed Dec. 29, 2014, 5 pages.
Opposition Against Clayton's European Patent 1 789 343 B1, "Information Regarding the Result of Oral Proceedings," Jan. 29, 2015, 3 pages.
Opposition Against Clayton's European Patent 1 789 343 B1, "Notice of Appeal," Filed Feb. 13, 2015, 1 page.
Opposition Against Clayton's European Patent 1 789 343 B1, "Minutes of the Oral Proceedings (including Annexes)," Mar. 3, 2015, 19 pages.
Opposition Against Clayton's European Patent 1 789 343 B1, "Interlocutory Decision in Opposition Proceedings (Art. 101(3)(a) and 106(2) EPC)," Mar. 3, 2015, 30 pages.
Opposition Against Clayton's European Patent 1 789 343 B1, "Annex to the Communication," Mar. 3, 2015, 5 pages.
PolyOne, "On Force(TM) LFT PE-33LGF/000 White," Provisional Datasheet, Mar. 14, 2012, 1 page.
RTP Company, "High Density Polyethylene (HDPE)," accessed from <http://www.rtpcompany.com/info/guide/descriptions/0700.htm> on Aug. 3, 2012, 1 page.
RTP Company, Letter to Clayton Corporation Regarding the Composition of RTP 703 CC and RTP 199X121708, dated Oct. 10, 2013, 1 page.
RTP Company, "RTP 703 CC HF High Density Polyethylene (HDPE) Glass Fiber High Flow," Product Data Sheet & General Processing Conditions, Mar. 3, 2011, 1 page.
Seymour, R. B., et al., Structure-Property Relationships in Polymers, 1984, pp. 134-137, Plenum Press.
Supplementary European Search Report issued for European Patent 1 789 343 B1, dated Jul. 29, 2008, 2 pages.
Technical Drawing, Faigle for Altachem NV, Mar. 5, 2004, 1 page.
Versuchsmusterprufbericht VM0281 Faigle to Altachem, dated Nov. 21, 2003, 1 page.
Visit Report, Dietmar Murnig (Faigle) to Altachem NV, dated Feb. 17, 2004, 5 pages.

* cited by examiner

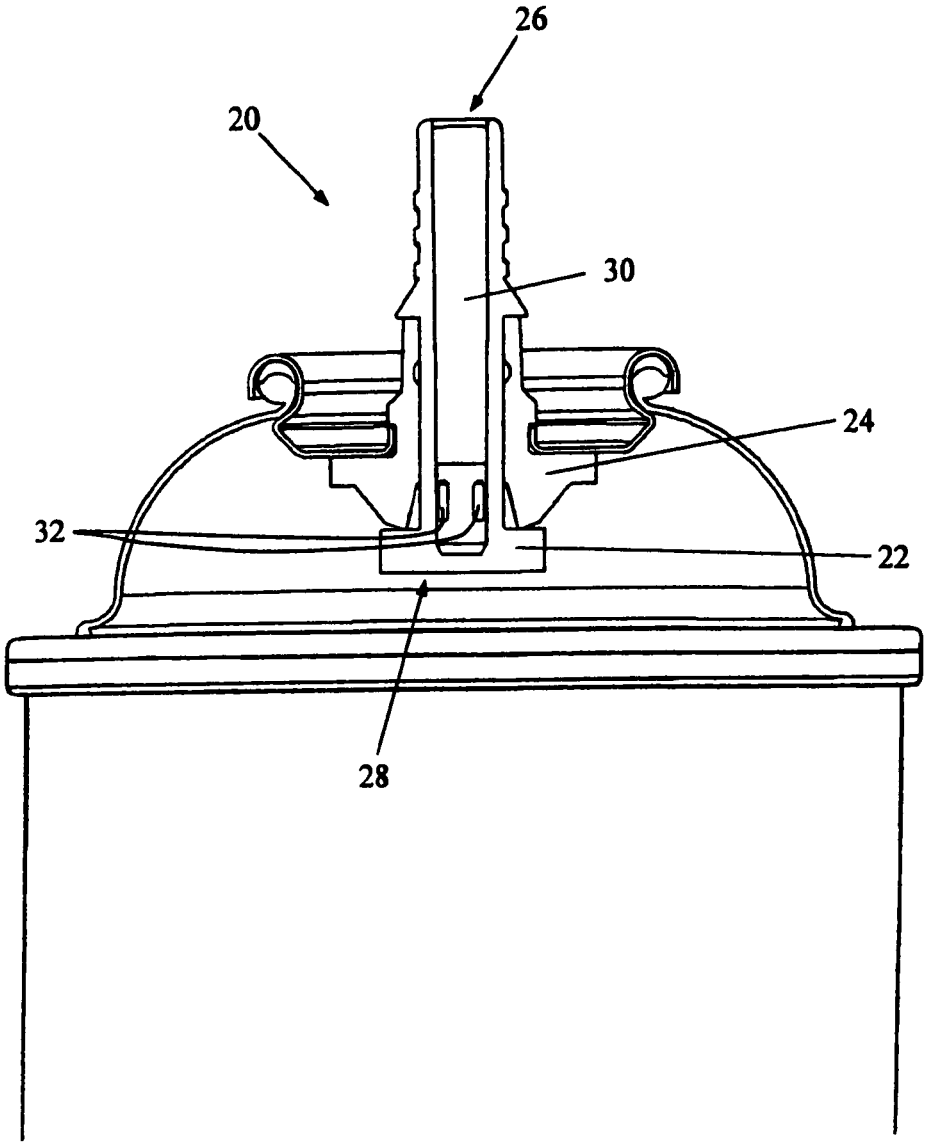
26
20
30
24
32
22
28

AEROSOL DISPENSER VALVE

CROSS-REFERENCE TO RELATED APPLICATIONS

This application is a continuation of U.S. patent application Ser. No. 13/189,656, filed Jul. 25, 2011, now U.S. Pat. No. 8,511,521, which is a continuation of U.S. patent application Ser. No. 11/228,000, filed Sep. 15, 2005, now U.S. Pat. No. 7,984,834, which claims the benefit of U.S. Provisional Patent Application Ser. No. 60/627,850, filed Nov. 15, 2004, and U.S. Provisional Patent Application Ser. No. 60/610,282, filed Sep. 16, 2004, the entire disclosures of which are incorporated herein by reference.

BACKGROUND OF THE INVENTION

This invention relates to aerosol dispenser valves for products, and in particular to dispenser valves for moisture curable products such as foams.

Moisture curable products, such as moisture curable polyurethane foams, have found wide application in homes and businesses. These foams are excellent fillers and insulators. The foams are often packaged in aerosol cans with a polypropylene dispenser valve. A problem with these valves is that moisture can migrate through the valve and into the aerosol can. Once inside, the moisture cures the foam, and impairs the function of the valve. The problem is exacerbated if the can is not stored upright, so that the contents of the can surround the valve member. The migration path is shorter, and when the foam cures around the valve member it interferes with the operation of the valve, sealing it closed.

SUMMARY OF THE INVENTION

A preferred embodiment of the present invention is a dispenser valve for a moisture-curable foam made from a glass-filled polyolefin. In the preferred embodiment the polyolefin is a high density polyethylene. The polyethylene preferably has a glass content of between about 2% and about 40%, and more preferably between about 10% and about 30%, and most preferably between about 15% and about 25%. The valve member of the preferred embodiment is more resistant to failure from moisture infiltration than the polypropylene valve members of the prior art. The valve member of the preferred embodiment is less adhesive than the propylene valve members of the prior art, so that to the extent that the contents of the container does inadvertently cure inside the container, it is less likely to adhere to the valve member and interfere with the operation of the valve. Thus embodiments of valves in accordance with the principles of this invention can extend the shelf life of urethane foams and other moisture curable or moisture affected products dispensed from aerosol cans.

BRIEF DESCRIPTION OF THE DRAWING

FIG. 1 is a cross sectional view of a dispenser valve for an aerosol can in accordance with the principles of this invention.

DETAILED DESCRIPTION OF THE PREFERRED EMBODIMENTS

A preferred embodiment of dispenser valve constructed according to the principles of this invention is indicated generally as 20 in FIG. 1. The dispenser valve 20 comprises a valve member 22 in a seal 24. The valve member 22 has first and second ends 26 and 28, and a central passage 30 extending partially therethrough. A plurality of openings 32 extend through the valve member 22 and communicate with the central passage 30. The openings are covered by the seal 24, but when the valve member 22 is deflected, it opens a space between the valve member 22 and the seal 24, so that the pressurized contents can exit the container between the valve member 22 and the seal, through the openings 32, and out the passage 30.

In accordance with the principles of this invention, the valve member 22 is made from a glass-filled polyolefin. The inventors believe that glass-filled polyethylene is more resistant to adhesion than the polypropylene valve members of the prior art, or other suitable polymer materials.

The inventors have also discovered that chemically coupled glass-filled polyolefin, and specific glass-filled polyethylene is less adhesive than the valve members of the prior art, to the extent that the foam does inadvertently cure inside the container, it is less likely to adhere to the valve member and interfere with the operation of the valve.

The polyethylene is preferably a high density polyethylene. The polyethylene preferably has a glass content of between about 2% and about 40%, and more preferably between about 10% and about 30%, and most preferably between about 20% and about 30%.

Thus the valve member of the preferred embodiment are more resistant to moisture infiltration, and less adhesive to moisture curing foams, such as polyurethanes. Thus the valves constructed in accordance with the valve members of this invention are less likely fail, even when the cans on which they are used are not properly stored, and provide a greater product shelf life.

Example 1

Cans of moisture curable polyurethane foam components were prepared with valve parts made of different plastics. The cans were stored upside down at ambient temperature and 90-100% relative humidity. Each week three cans of each type were examined and rated on whether the can was fully functional, stuck but functional, or stuck. Failure was determined when all three cans of the sample failed. The results of the test are given in Table 1.

TABLE 1

| 20% glass-filled polyethylene | Impact modified propylene | Polypropylene | Acetal | Internally Lubricated polypropylene |
|---|---|---|---|---|
| No failure after 16 weeks. | Failure after 5 weeks. | Failure after 5 weeks. | Sticking after 7 weeks; failure after 9 weeks | Sticking after 5 weeks; failure after 6 weeks |

Example 2

Cans of moisture curable polyurethane foam components were prepared with valve parts made from different plastics. Sixteen cans of each type were stored upside down at 120° at 80% relative humidity for 11 weeks. Cans were inspected at the end of 11 weeks to determine whether the valves were stuck or were functional. The results are given were given in Table 2.

TABLE 2

| Plastic | Number of stuck valves | % of stuck valves |
|---|---|---|
| 50% polyethylene and 50% polyethylene with 20% glass | 0 | 0% |
| 100% polyethylene with 20% glass | 2 | 12.5% |
| 90% polyethylene - 10% polypropylene with 30% glass | 3 | 18.8% |
| 75% polyethylene - 25% polypropylene with 30% glass | 3 | 18.8% |
| 100% polypropylene | 4 | 25% |
| 50% polyethylene - 50% polypropylene | 5 | 31.3% |
| 50% polyethylene - 50% polypropylene with 30% glass | 5 | 31.3% |
| 100% polyethylene - | 6 | 37.5% |
| 90% polyethylene - 10% polypropylene | 6 | 37.5% |
| 75% polyethylene - 25% polypropylene | 10 | 62.5% |

This test shows that valves made of glass filled polyethylene (from 10% to 20%) had the lowest number of stuck valves.

Example 3

Cans of moisture curable polyurethane foam components were prepared with large valve parts made from different plastics. Twenty-two cans of each type were stored upside down at ambient with caps filled with water. Two cans of each type were tested periodically, and it was noted whether the valve worked, whether the valve was stuck but broke free, or whether the valve failed. The results are given in Table 3.

TABLE 3

| 20% glass-filled polyethylene | Polypropylene | Acetal |
|---|---|---|
| No failure after 22 weeks. | Stuck but broke free, after 18 weeks. | Stuck but broke free, after 13 weeks-failure after 22 weeks |

Example 4

Cans of moisture curable polyurethane foam components were prepared with small valve parts made from different plastics. Twenty-two cans of each type were stored upside down at ambient with caps filled with water. Two cans of each type were tested periodically, to determine whether the valve worked, whether the valve was stuck but broke free, or whether the valve failed. The results are given in Table 4.

TABLE 4

| 20% glass-filled polyethylene | Impact Modified Polypropylene | Acetal | Ethylene Telefluorethylene polymer (ETFE) |
|---|---|---|---|
| No sticking or failure after 22 weeks. | Failed, after 8 weeks. | Stuck but broke free, after 12 weeks; failure, after 17 weeks. | Failures after 19 weeks |

Example 5

Cans of moisture curable polyurethane foam components were prepared with valve parts made from different plastics. Cans of each type were stored upside down with caps filled with water at 130° F. (to accelerate sticking of the valves). Two cans of each type were periodically tested to determine whether the valve worked, whether the valve was stuck but broke free, or whether the valve failed. The results are given were given in Table 5.

TABLE 5

| 20% glass-filled polyethylene | Polypropylene | Acetal |
|---|---|---|
| No sticking or failure after 51 days. | Stuck but broke free after 14 days, failure after 35 days. | Stuck but broke free after 14 days; failure after 37 days. |

Example 6

Cans of moisture curable polyurethane foam components were prepared with valve parts made from different plastics. Cans of each type were stored upside down with caps filled with water at 130° F. (to accelerate sticking of the valves). 20% glass filled polyethylene was compared with impact modified propylene for two different neoprene seal materials. Two cans of each type were periodically tested to determine whether the valve worked, whether the valve was stuck but broke free, or whether the valve failed. Failure was determined when both valves tested stuck or failed. The results are given were given in Table 6.

TABLE 6

| Seal 1 | | Seal 2 | |
|---|---|---|---|
| 20% glass-filled polyethylene | Impact Modified polypropylene | 20% glass-filled polyethylene | Impact Modified polypropylene |
| No sticking or failure after 23 days. | Failure after 11 days. | Failure, after 21 days. | Failure after 11 days. |

This testing indicates that glass-filled polyethylene provides improved performance with different seal materials.

Example 7

Cans of moisture curable polyurethane foam components were prepared with valve parts made from different plastics. Cans of each type were stored upside down with caps filled with water at 130° F. (to accelerate sticking of the valves).

20% glass filled polyethylene was compared with propylene and with a conventional valve using a stick resistant coating on the seal. Two cans of each type were periodically tested to determine whether the valve worked, whether the valve was stuck but broke free, or whether the valve failed. The results are given were given in Table 7.

TABLE 7

| 20% glass-filled polyethylene | Polypropylene | Polypropylene with stick resistant seal coating |
|---|---|---|
| Stuck but broke free after 30 days; no failure at 36 days | Stuck but broke free after 22 days; failure after 28 days | Stuck but broke free after 22 days; failure after 30 days |

This testing indicates that glass-filled polyethylene continued to function after conventional valves and conventional valves with lubricated seals, failed.

Example 8

Cans of moisture curable polyurethane foam components were prepared with gun valve (vertically opened) parts made from different plastics. Sixteen cans of each type were stored upside down at 130° with caps full of water. Two cans of each type were tested periodically, and its was noted whether the valve worked, whether the valve was stuck but broke free, or whether the valve failed. Failure was determined by sticking or failure of both cans. The results are given were given in Table 8.

TABLE 8

| Plastic | First Sticking | First Failure |
|---|---|---|
| 100% polyethylene with 20% glass-filled polyethylene (ribbed for extra strength) | — | — |
| Impact Modified Polypropylene co-polymer (ribbed for extra strength) | 10 days | — |
| Polypropylene | 13 days | 55 days |
| Acetal | 10 days | 33 days |
| Impact Modified Polypropylene | 13 days | 33 days |
| Polyethylene | — | 26 days* |
| 75% polyethylene - 25% polypropylene | 10 days | |
| 50% polyethylene - 50% polypropylene | 10 days | |
| 100% polyethylene with 20% glass-filled polyethylene | — | — |
| Impact Modified Polypropylene | 10 days | |

*stem failure due to weakness of material

This testing shows the superiority of glass filled polyethylene in both ribbed and unribbed configurations.

Example 9

Cans of moisture curable polyurethane foam components were prepared with gun valve (vertically opened) parts made from different plastics. Twelve to Fourteen cans of each type were stored upside down at 130° with caps full of water. Cans of each type were tested periodically, and its was noted whether the valve worked, whether the valve was stuck but broke free, or whether the valve failed. Failure was determined by sticking or failure of both cans. The results are given were given in Table 9 below, which shows that some standard valves first stuck after only six days and the standard valves were stuck after 11 days, as compared to the valves with 20% glass-filled Polyethylene valve components which were not stuck after 20 days of testing. All of the 20% glass-filled Polyethylene valve components performed longer than the standard components. The plastic used is a 703 CC chemically coupled 20% glass filled polyethylene available from RTP company, having an impact strength (notched) of about 2.5 ft. lbs./inch and a water absorption of about 0.04 percent.

TABLE 9

| Plastic | First Stuck | Valves stuck |
|---|---|---|
| 100% Polyethylene with 20% glass-filled stems | none of 14 samples stuck | no samples stuck after 20 days |
| Impact Modified Polypropylene co-polymer (ribbed for extra strength) | samples first stuck w/in 6 days | 12 samples stuck w/in 11 days |

In the testing conducted, a glass filled polyethylene was always the best performer, and only one other material—acetal—approached the performance of the glass-filled polyethylene in certain circumstances. Glass-filled polyethylene valve stems show surprisingly superior resistance to sticking (i.e. longer times to initial sticking, and longer times to valve failure) over valve stems of other materials in a variety environments, different valve sizes, and different sealing materials. Glass-filled polyethylene even showed superior resistance to sticking than conventional valves with available stick resistance coatings.

While the description of the preferred embodiment and the examples and tests focused primarily on moisture curable foams, and more specifically moisture curable polyurethane foams, the invention is not so limited and the valves and containers with valves of the present invention can be used with other moisture curable products that are dispensed from aerosol cans, and even with products that are not moisture curable, but adversely affected by moisture infiltration.

What is claimed is:

1. An aerosol can for dispensing a moisture-curable foam comprising:

an aerosol can;

a moisture-curable foam disposed within the aerosol can; and a valve comprising:

a seal; and a valve member, the valve member being constructed to resist adherence of cured moisture-curable foam to the valve member, the valve member comprising a central passage extending partially therethrough, and a plurality of openings extending through the valve member and in communication with the central passage, the valve member being adapted for movement upon actuation between a first position in which the valve member is deflected off of the seal to allow the moisture-curable foam to flow into the central passage, and a second position in which the valve member seats on the seal to prevent flow of the moisture-curable foam into the central passage, the valve member being comprised of a glass filled polyolefin and being more resistant to adhesion to the cured moisture curable foam than the same valve member having no glass content.

2. The aerosol can according to claim 1 wherein the glass filled polyolefin is a chemically-coupled glass filled polyolefin.

3. The aerosol can according to claim 1 wherein the glass-filled polyolefin is a polyethylene.

4. The aerosol can according to claim 3 wherein the glass filled polyethylene is a chemically-coupled glass filled polyethylene.

5. The aerosol can according to claim 1 wherein the glass content is between about 2% and about 40%.

6. The aerosol can according to claim 1 wherein the glass content is between about 3% and about 40%.

7. The aerosol can according to claim 1 wherein the glass content is between about 8% and about 40%.

8. The aerosol can according to claim 1 wherein the glass content is between about 10% and about 40%.

9. The aerosol can according to claim 1 wherein the glass content is between about 2% and about 30%.

10. The aerosol can according to claim 1 wherein the glass content is between about 3% and about 30%.

11. The aerosol can according to claim 1 wherein the glass content is between about 8% and about 30%.

12. The aerosol can according to claim 1 wherein the glass content is between about 10% and about 30%.

13. The aerosol can according to claim 1 wherein the moisture-curable foam comprises at least two liquid components.

14. The aerosol can according to claim 1 wherein the moisture-curable foam is polyurethane foam.

15. The aerosol can according to claim 1 wherein the seal is made of neoprene.

* * * * *